United States Patent [19]

Turk et al.

[11] 4,241,571

[45] Dec. 30, 1980

[54] APPARATUS FOR OPEN-END OR ROUND-ABOUT SPINNING OF A THREAD

[75] Inventors: Herbert Turk, Remscheid; Herbert Schiminski, Hückeswagen, both of Fed. Rep. of Germany

[73] Assignee: Barmag Barmer Maschinenfabrik AG, Remscheid-Lennep, Fed. Rep. of Germany

[21] Appl. No.: 20,035

[22] Filed: Mar. 13, 1979

[30] Foreign Application Priority Data

Mar. 13, 1978 [DE] Fed. Rep. of Germany ..... 2810843

[51] Int. Cl.[3] ..... D01H 1/12

[52] U.S. Cl. ..... 57/58.89; 57/5; 57/58.95

[58] Field of Search ..... 57/5, 6, 58.89–58.95

[56] References Cited

U.S. PATENT DOCUMENTS 4,130,983 12/1978 Dammann et al. ..... 57/5

4,165,600 8/1979 Schippens et al. ..... 57/58.95

*Primary Examiner*—John Petrakes

*Attorney, Agent, or Firm*—John H. Shurtleff

[57] ABSTRACT

Apparatus for the open-end spinning or round-about spinning of a twisted thread from individual, discrete fibers using a known combination of paired rollers or drums, preferably air-permeable, perforated rollers or sieve drums cooperated with suction means within the rollers or drums to produce a line of thread formation extending longitudinally within the wedge-shaped nip formed by the rollers or drums, and further including a feed channel to supply individual fibers into the nip for twisting by the rollers or drums, and means to take off the twisted thread at one end of the nip. The apparatus is adjusted according to the invention to widen the nip in the plane of the thread forming line and in the direction of the thread take-off. Two equivalent adjustments of the nip lead to a spun thread of higher strength and better uniformity.

18 Claims, 6 Drawing Figures

APPARATUS FOR OPEN-END OR ROUND-ABOUT SPINNING OF A THREAD

BACKGROUND OF THE INVENTION

Yarn spinning processes and suitable apparatus are known from U.S. Pat. No. 4,130,983 for the so-called "open-end spinning" of individual fibers into a twisted thread or the similar "round-about spinning" to cover a continuous core thread with a sheath of individual fibers, these processes being carried out by twisting together the individual fibers on a defined thread formation line in the zone of the gap between two surfaces moving in opposite directions and by taking off the thread perpendicularly or obliquely to the direction of travel of the moving surfaces. In the apparatus for such spinning processes, it is possible to use a variety of cooperating elements as the moving surfaces, but as described in said U.S. Pat. No. 4,130,983 and also in our copending application Ser. No. 7,944, filed Jan. 20, 1979, these moving surfaces are preferably designed as cylindrical, hyperbolic or conical rollers or drums, particularly as air-permeable, perforated rollers or sieve drums which rotate in the same direction and form between a pair of them a narrow gap or nip as a thread forming zone. The narrowest gap between the two drums or rollers is essentially defined by parallel mantle lines lying in substantially one common plane.

In our application Ser. No. 7,944, it is suggested that the width of the narrowest gap can be narrowed in the draw-off direction of the thread in order to assist the axial conveying movement of the thread being formed. This proposed adjustment of the gap was based on the theory that a torsional movement is imparted to the thread being formed at a position where it is already present as a finished structure, as also demonstrated for example in the German published application No. 2,518,754. Other devices such as disc members at the outlet end or draw-off end of the drums or rollers were also suggested as an alternative means of assisting the axial conveying movement of the thread.

SUMMARY OF THE INVENTION

It has now been found, in accordance with the invention, that in contrast to the previous theory and contrary to all expectations, one can achieve a substantial and reproducible increase in the quality of the spun thread product as obtained by the open-end or round-about spinning processes provided that the width of the wedge-shaped nip increases on the plane of the thread formation line and in the direction of travel of the thread, i.e. in the thread take-off direction.

The improvement of the present invention is one which is essentially directed to apparatus used for the specific methods of open-end spinning or round-about spinning of a twisted thread from individual, discrete fibers, such apparatus comprising two elongated drums arranged to rotate in the same direction and to provide a wedge-shaped nip ending at the common normal plane of said drums to define the narrowest gap which is formed by the respective generatrix lines of the two drums, a feed channel to supply the individual fibers by means of an air stream directed into the wedge-shaped nip for thread formation, and means to take off the twisted thread at one end of the nip, said drums, feed channel and take-off means cooperating to produce a line of thread formation extending longitudinally within the wedge-shaped nip.

Especially good results are achieved by adopting at least one and preferably two perforated drums, e.g. as in our earlier copending application Ser. No. 7,944, together with air suction means with an opening face and/or faces located within each perforated drum to produce respective air streams entering into each of said one or two perforated drums and cooperating to produce or develop a line of thread formation extending longitudinally within the wedge-shaped nip. In addition, it is advantageous to adopt a feed channel to supply the individual fibers by means of an air stream directed into the wedge-shaped nip along said line of thread formation, especially so that the individual fibers are directed by the air stream with a component of movement against the take-off direction of the thread. The use of drums having the form of hyperboloids, particularly a pair of asymmetric hyperboloids, is also preferred for purposes of the present invention.

The width of the nip in the plane of the thread formation line is preferably adjusted to the effective diameter of the thread being formed and drawn off from the nip. The initial or starting width is thus selected so as to be less than 50%, preferably less than 30%, of the diameter of the finished twisted thread. The width of the nip increases to a final width which is at least about 2 times, e.g. 2 to 4 times, as large as the initial width. The initial width of the nip, i.e. in the region of the open end of the thread, preferably amounts to about 10 to 30% of the diameter of the spun thread product, the width then preferably increasing over the length of the thread formation line by about 3 to 10 times the initial width. It should be noted that the open end of the thread corresponds to the beginning of the sheath or covering layer of fibers being twisted around a core thread in a round-about spinning process.

It has been found that with this construction and arrangement of the nip width in the plane of the thread formation and with operating parameters which are otherwise identical, it is possible to achieve an improvement in thread quality of more than 30% in comparison to a constant nip width or a nip which narrows in the take-off direction of the thread. The "spinning in" or twisting of the interior fibers of the thread is particularly guaranteed by the present invention.

As a matter of definition, the thread diameter of the finished twisted thread is to be calculated according to the formula:

$$d = \frac{1.12838}{\sqrt{\gamma \times Nm}}$$

wherein d is the diameter in mm, $\gamma$ is the specific gravity of the thread in g/cm, and Nm is the yarn size in m/g.

A number of useful and particularly desirable embodiments of open-end or round-about spinning apparatus can be readily selected from the following disclosures with particular reference to the figures of the drawings and the description of these figures:

U.S. Pat. No. 4,130,983;

German published application No. 2,656,787; and

U.S. application Ser. No. 7,944 as noted above.

These disclosures are incorporated herein by reference as fully as if set forth in their entirety, particularly to offer a wider selection of known or earlier proposed elements of the apparatus assembly, e.g. various paired moving surfaces and especially paired rollers or drums having fiber-receiving and thread rolling or twisting surfaces adapted to take up the individual fibers as they are fed into the wedge-shaped nip and twist them into a thread or wrap them about a core thread.

It should be noted that an adjustment of the nip is not illustrated by the drawings in this application due to the very small dimensions involved. The required widening of the nip over its length in the thread draw-off direction can be predetermined to construct the drums or rollers to be mounted in fixed or non-adjustable axial positions. It is preferable, however, to mount the drums or rollers on suitable bearings or journalled support members which can be adjusted at either end of each drum or roller. For example, the support members can be mounted in tracking grooves or similar guide means permitting movement of each drum or roller axis in a lateral direction, i.e. perpendicular to the axis of rotation, at the inner end where the open end of the thread is located, while at the same time providing a swinging or pivotal movement as well as a lateral movement of each drum or roller axis at its outer or draw-off end, thereby offering an adjustment of the drum or roller axes into exactly parallel positions or up to a precise narrow angle widening the nip toward the draw-off end, preferably in such a manner that the generatrix lines of the drums on either side of the narrowest gap are always symmetrically positioned with respect to the line of thread formation.

In practice, a very high precision is required in mounting the drums or rollers and in providing an adjustment of the width of the nip over its length. Such precision mounting means are well within the skill of an ordinary mechanic in this art, and the invention is not limited to any specific support means or adjusting means in setting the width of the wedge-shaped nip or its narrowest gap.

The individual fibers are preferably fed into the wedge-shaped nip at a high flow rate by an air stream directed by a feed or guide channel whose side walls lying approximately in the plane of the thread formation line are inclined at an angle of less than 30° with reference to the thread formation line or with reference to the narrowest gap of the wedge-shaped nip. In some applications, it is especially desirable for the feed channel to be arranged such that the individual fibers are directed by the air stream to impinge upon the thread formation line with a speed component or vector of movement which is directed against the thread take-off direction.

The type of air suction, in particular that falling within the subject matter of U.S. Pat. No. 4,130,983, is not absolutely essential for obtaining the distinct advantages in quality according to the present invention, although such special air suction means are helpful in a preferred embodiment to achieve the best possible results in the spinning process and in the desired uniform and high quality of the final thread product.

The air suction devices of U.S. Pat. No. 4,130,983 are distinguished by the fact that the opening faces or mouth areas of these earlier disclosed embodiments extend along the thread formation line and are so arranged, as viewed in the direction of movement of the cylindrical or hyperbolic drum, such that the thread formation line develops at the end of the opening face, i.e. along its trailing longitudinal edge portion. The opening faces can overlap slightly in the zone of the thread formation line, i.e. where the trailing longitudinal edge portions have relative positions overlapping each other in the zone of said thread formation line, preferably with an overlap of not more than 10 times the thread diameter. This overlapping region preferably lies slightly above the narrowest gap of the wedge-shaped nip.

For this particular embodiment, i.e. where the air suction means is arranged to position the line of thread formation, the present invention can also be realized even when the narrowest gap is maintained with a constant width over its length, i.e. with a constant distance maintained between the drum or roller surfaces in the plane of the narrowest gap which corresponds to the common no mal plane of the two drums or rollers. In this case, the opening faces or mouth areas of the air suction means, and especially their trailing boundary lines or edges, are positioned so that they define a thread formation line which is inclined to the plane of the narrowest gap. These trailing edges and the resulting thread formation line are thus inclined with respect to the plane of the narrowest gap such that their distance from the plane of the narrowest gap increases in the thread take-off direction. This allows the thread formation line and the corresponding thread formation plane to be inclined to the plane of the narrowest gap such that the width of the wedge-shaped nip widens along the thread formation line in the thread formation plane.

The same result can also be achieved with other arrangements of the air suction means described in this specification, whereby the thread formation line and its plane can be accurately defined and fixed. The thread formation plane is generally fixed either to coincide with the common normal plane of the drums or else at an angle of inclination outside this common normal plane but intersecting it on a line substantially perpendicular to the thread formation line.

THE DRAWINGS

A number of embodiments of the invention are described below with reference to the accompanying drawings in which similar parts are identified by the same reference numerals and in which.

Figure 1:
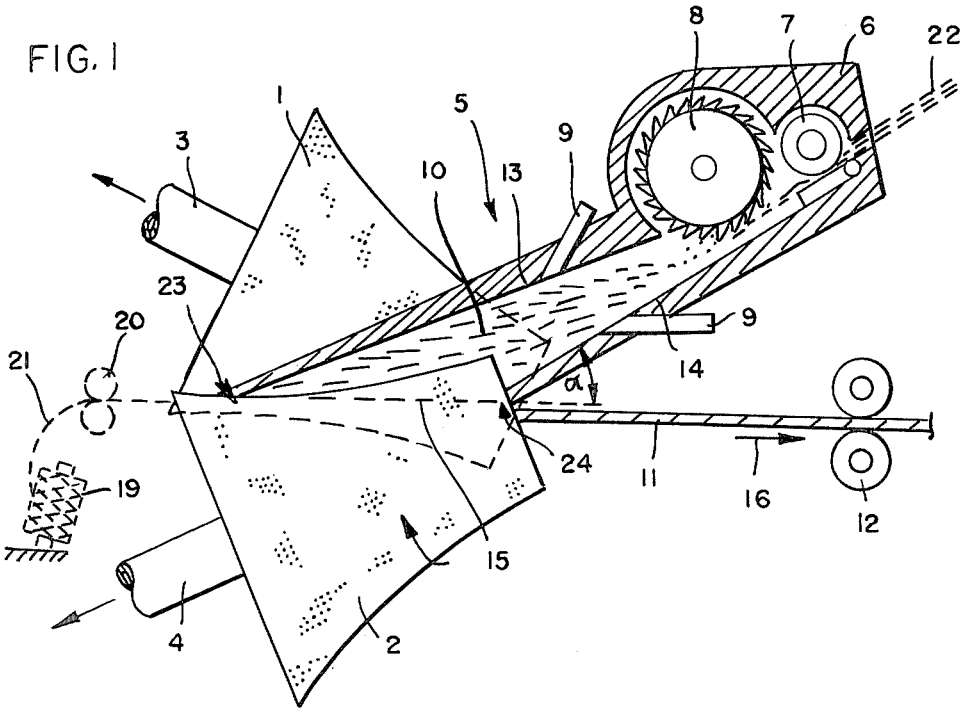
FIG. 1 is a sectional view along the axis of thread formation of one preferred embodiment of the invention, including a schematic representation of suitable means to supply a continuous core filament for a roundabout spinning if this is desired.
Figure 2:
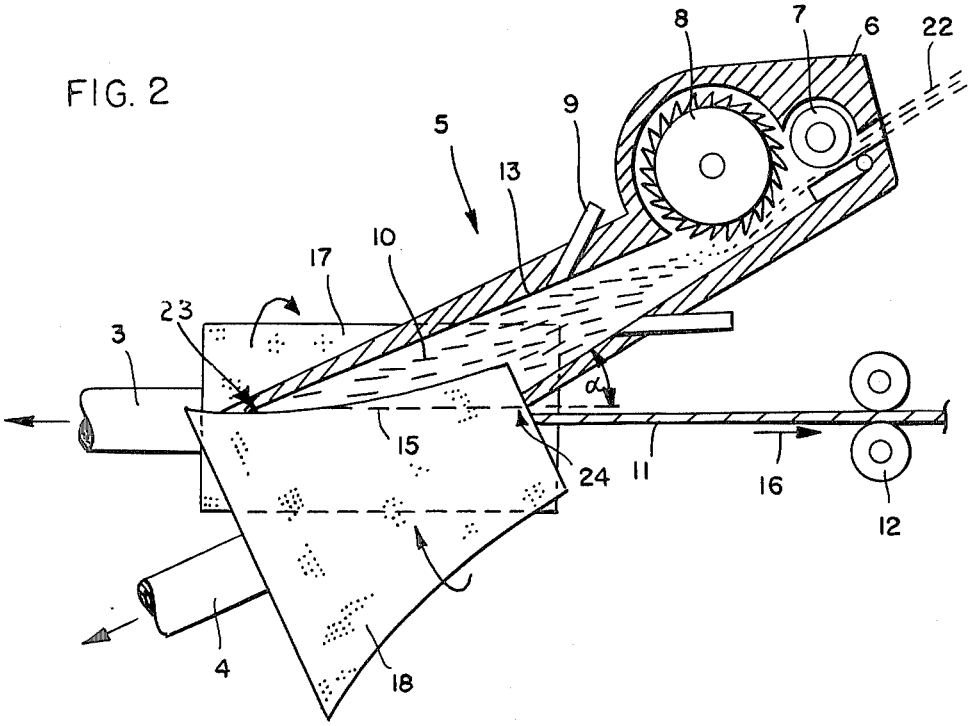
FIG. 2 is a sectional view similar to FIG. 1 but illustrating another preferred embodiment using a different set of air-permeable rollers or sieve drums.

It will be noted that FIGS. 1 and 2 are essentially identical with the same two figures in our copending application, Ser. No. 7,944, since the apparatus remains the same except for the precise adjustment of the nip or narrowest gap such that it widens in the direction of the thread take-off, i.e. to the right as illustrated in both cases.

DESCRIPTION OF THE PREFERRED EMBODIMENTS

The following is a more detailed description of a number of preferred embodiments of the invention, it being understood that the invention is not limited to these few examples which are intended to be illustrative only.

Referring first to FIG. 1, the two rollers or drums 1 and 2 are constructed as asymmetrical hyperboloids and have perforated, air-permeable mantle surfaces. These rollers are driven in the same direction of rotation and at the same speed by a suitable variable speed motor (not shown here but see FIGS. 4 and 4*a* of U.S. Pat. No. 4,130,983). Air suction devices are arranged inside of each of the rollers 1 and 2, with suction lines 3 and 4 being connected to an air vacuum or air exhausting means to create a flow of air inwardly through the perforated roller surfaces. The arrangement of the mouth of each suction device is described below.

Each mouth or opening of the air suction means is preferably located upstream of the thread formation line, as viewed in the direction of movement of its respective roller surface in the region of the narrowest gap, only a slight overlap of the opposing mouths being considered, e.g. up to about 10 times the thread diameter.

The fiber feed channel 5 extends into the wedge-shaped nip between the two rollers 1 and 2 and is connected at its entry end to the housing 6 which is illustrated somewhat schematically in its function of loosening and separating the roving feed 22 into many short lengths, e.g. staple lengths, of individual, discrete fibers. Thus, the roving 22 is introduced by means of the intake or feed roller 7 and is then opened into the individual fibers by means of the toothed carding or loosening roller 8. The axis of rotation of the carding roller 8 can be arranged as shown to extend perpendicularly to the line of thread formation, but it may also lie in the same plane as the line of thread formation, i.e. parallel to the fiber feed channel.

The individual fibers 10 are positively conveyed in the fiber feed channel 5 by an air stream produced by the injectors or jet nozzles 9 so as to flow in a controlled manner toward the narrowest gap formed between the two rollers 1 and 2 on their common nomal plane. The individual fibers are met by the suction air currents in the region of the narrowest gap and are pressed against the roller surfaces by these currents and twisted together to form a thread 11 or, as indicated in FIG. 1, the individual fibers are spun as a sheath around the core thread 21 being taken off the delivery bobbin 19 by means of the paired feed rolls 20. The produced thread 11 is then taken off by the draw-off rollers 12 which are positioned to receive the product on approximately the same line as the thread formation line 15, the arrow 16 indicating the direction of travel of the twisted thread product 11.

In the schematic cross section of FIGS. 1 and 2, the feed channel 5 consists essentially of the front wall 13 and the back or rear wall 14 when viewed in the direction of thread draw-off. The mouth or feed opening 15 of the feed channel 5 coincides with the thread forming line and is arranged substantially parallel to the narrowest gap falling on the common normal plane of the two rollers. The front and rear side walls 13 and 14 are inclined at an angle to the thread formation line and suction mouth 15, i.e. at the angle $\alpha = 45°$ or less, preferably below about 30° and especially below about 10° to 15°. The smaller the angle, the better are the results. For geometric and mechanical reasons, there is obviously a lower limit to this angle of inclination of the feed channel.

In the preferred embodiments of FIGS. 1 and 2, the feed channel is also constructed and arranged such that the individual fibers 10 meet or impinge upon the thread formation line with a component or vector of movement against or counter to the draw-off direction 16 of the thread 11. With this arrangement, the individual fibers are substantially completely bound into the thread over its length so that the compactness of the spun thread is improved in this way. Thus, this feature of the process prevents unbound fibers from being stripped off from the thread during subsequent processing, and the appearance of so-called "belly binders" formed by only partly bound in fibers is also avoided.

The front and rear side walls 13 and 14 need not be parallel to each other, the angle $\alpha$ being defined as the angle between the steepest side wall and the opening or thread line 15. The air injection nozzles 9 are preferably arranged in both of these side walls 13 and 14 to provide a better contrrol over the distribution and orientation of the individual fibers 10.

If for any reason it is preferred to a draw off the spun thread in a different direction, e.g. opposite to the arrow 16, then the fiber feed channel should also be arranged at a suitably different inclination.

The embodiment of FIG. 2 essentially corresponds in all of its important details with the embodiment of FIG. 1. The foregoing explanation of FIG. 1 thus applies in practically all details to FIG. 2, except for the following. In this case, the spinning unit of rollers or drums consists, on the one hand, of the cylindrical roller 17 and, on the other hand, of the hyperbolic roller 18 which is carefully adapted to the adjacent cylindrical roller. Thus, the cylindrical roller 17 is arranged such that its generatrix forms the nip or narrowest gap with a straight line generatrix of the hyperbolic roller 18, the thread being formed by the action of both rollers moving in opposite directions on either dside of the narrowest gap. Both rollers 17 and 18 are permeable to air and also contain the preferred suction devices on their interior, as already described with reference to FIG. 1. This particular combination of a cylindrical and a hyperbolic roller permits a somewhat simpler execution of the wedge-like narrowing of the nip between the rollers, since there are no objectionable intersections or overlapping projections as occur in a machine construction using two hyperboloids.

It must be noted again that the present invention is not restricted to specific embodiments described herein as the best mode of the invention. By way of further examples, the invention may be advantageously used in spinning apparatus having two cylindrical rollers on parallel axes of rotation or in an apparatus having hyperboloid rollers designed in a different manner. The rollers may also be in the form of truncated cones. Also, the suction devices may be constructed and arranged in many suitable ways other than those described as particular embodiments herein.

The design of the rollers and the arrangement of the suction means as set forth in FIGS. 1 and 2 does have significant advantages, however, both in reliability of operation and also in an improved thread quality, and particularly when working with a thread or yarn of low denier, i.e. very fine yarn sizes. Since these structural features form the subject matter of our copending application Ser. No. 7,944, it will be understood that the further combination of such features in the present invention is highly desirable but not essential in terms of an improvement over the prior apparatus of others. The unique widening of the nip in the plane of the thread formation has its own pronounced effect in the improvement of the structure and quality of the final spun thread, especially within the further limitations of a gradual widening of this gap from the initial or open end 23 of the thread forming line up to the outlet or draw-off end 24. Here, the object is to approximately match or conform the width of the nip to the thread being formed, preferably so that the nip is slightly smaller than the thread diameter over at least the last segment of the forming thread from about the middle of the roller or drum length up to its draw-off point 24.

Figure 3:
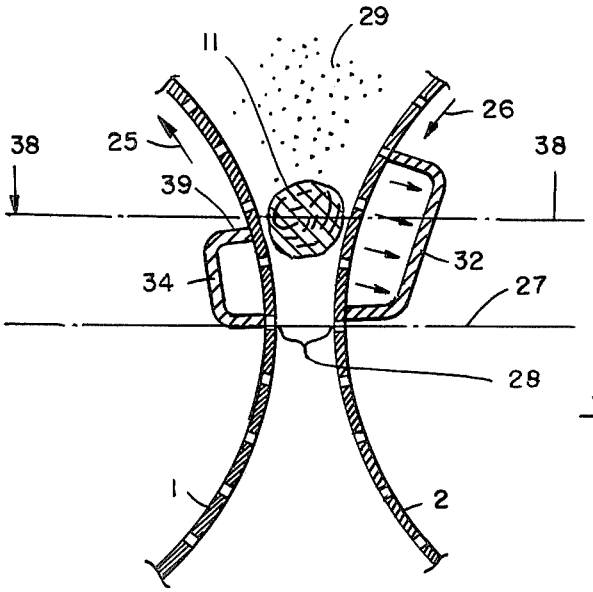
FIG. 3 is a schematic partial view of a cross section through two rollers with one example of suction means and showing the position of the thread.

Another aspect of the invention is illustrated by FIG. 3 where the rollers 1 and 2 are set forth schematically in cross section with portions omitted away from the thread forming region. Roller 1 is rotated in the direction 25 while roller 2 is rotated in the direction 26. No attempt has been made in this FIG. 3 to provide an accurate geometric portrayal of the individual elements but rather to give essential details with this highly diagrammatic sketch of the apparatus. With this understanding, attention is directed to the fact that the rollers 1 and 2 form the wedge-shaped nip in front of their common normal plane 27. This wedge-shaped nip ends at the narrowest gap 28 as formed by the respective generatrix line of each of the two rollers. The thread 11 is formed in the wedge-shaped nip by collecting and twisting individual fibers from the fiber cloud 29. The feed channel 5 for directing the fiber cloud is omitted in FIG. 3. For the sake of clarity, it should also be noted that the thread is drawn off out of the plane of the paper, i.e. toward the reader, when viewing FIG. 3.

The mantle lines or generatrices which define the narrowest gap 28 are placed on the common normal plane of the two rollers 1 and 2 in accordance with the invention and by definition the narrowest gap must coincide with this common normal plane. However, these two generatrices do not run parallel to each other but in such a way that the narrowest gap 28 widens in the draw-off direction of the thread (out of the plane of the paper).

In one working example, using the apparatus according to FIGS. 1 and 3, a polyester thread (Nm=40) was produced in a first run with an exact parallel adjustment of the narrowest gap 28, whereby the spun thread product exhibited a tensile strength averaging 12.4 Reiss-kilometer (Rkm). This tensile strength could be increased to an average value of 16.8 Rkm simply by adjusting the narrowest gap in accordance with the invention such that it had a width of 5/100 mm at the initial or open end 23 of the thread formation and a width of 17/100 mm at the outlet or draw-off end 24.

The suction devices 32 and 34 are positioned in FIG. 3 substantially opposite each other along the internal surface of their respective rollers 2 and 1 where air is drawn through the perforated roller surfaces as indicated by the arrows in the suction compartments. However, both suction devices are mounted above the common normal plane 27 in the region of the upper wedge-shaped nip as formed between the two rollers. This embodiment of the invention is characterized by the fact that the suction device 32 on roller 2 has a larger opening face or mouth in the circumferential direction of the roller than the opposite suction device 34 on roller 1. This arrangement permits the suction device 32 of roller 2 conveying fibers into the nip, according to the direction of rotation 26, to collect an optimum amount of fibers from the cloud 29 and to convey these collected fibers into the line or plane of thread formation 38, while on the other hand the suction device 34 with its boundary line or leading edge 39 extends only to the thread formation line or plane 38, serving primarily to stabilize the thread formation on the predetermined thread forming plane 38 within the wedge-shaped nip.

Figure 4:
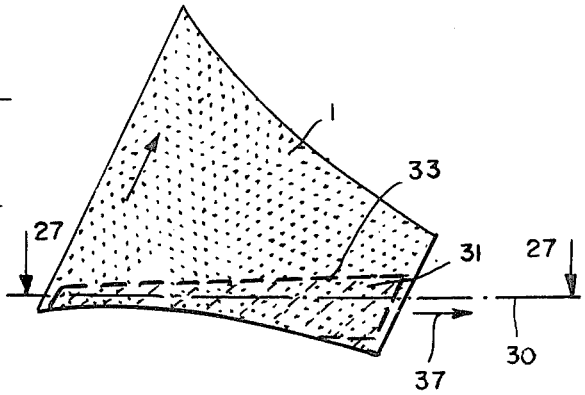
FIG. 4 is a partly schematic side elevation of one of the hyperbolic rollers of FIG. 1, other parts being omitted in order to more clearly show the arrangement of one suction means in relation to the resulting line of thread formation.
Figure 5:
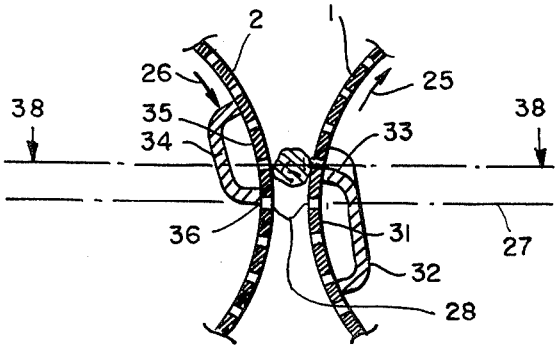
FIG. 5 is a schematic partial view of a set of rollers taken from FIG. 1 and shown in cross-section with their associated air suction means.
Figure 6:
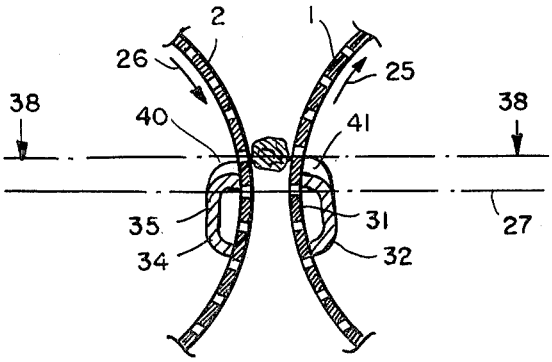
FIG. 6 is a schematic partial view similar to that of FIG. 5 but with yet another arrangement of air suction means, all in cross-section including the thread positioned between the two rollers.

FIG. 4 provides a similar working view of the roller 1 as a side view taken from FIG. 1, while FIGS. 5 and 6 are similar to FIG. 3 in setting forth a highly schematic and geometrically distorted view of cross sections of the rollers 1 and 2, illustrating other arrangements of the suction devices. It should be noted that in FIGS. 5 and 6, the thread 11 runs into the plane of the paper, i.e. away from the reader In FIG. 4, the direction of take-off of the spun thread is designated by the numeral 37.

The special feature of the invention which is illustrated by FIGS. 4, 5 and 6 resides in the fact that the opening face or mouth 31 of the suction device 32 as well as the opening face or mouth 35 of the suction device 34 are inclined to the common normal plane 27 of rollers 1 and 2, and therefore also inclined to the plane of the narrowest gap 28, such that the distance from the edges of the boundary lines 33 and 36 in FIG. 5 or the upper edges of the boundary lines 40 and 41 of FIG. 6 to the common normal plane increases in the direction of thread travel, i.e. in the thread draw-off direction. This arrangement permits the thread, which stabilizes its line of thread formation in the region of the boundary lines or edges 33, 36 (FIG. 5) or the upper edges 40, 41 (FIG. 6) of the opening faces or mouths 31, 35, respectively, to develop on a path or line of thread formation which is inclined to the common normal plane 27. In other words, this line of thread formation rises in the direction of thread draw-off. The thread is thus formed in the nip between rollers 1 and 2 in a plane 38 of thread formation having a width which increases in the direction of thread draw-off. Thus, it is not essential to widen the narrowest gap between the rollers or drums because the same effect can be achieved by inclining the plane of thread formation at a slight angle to the common normal plane of the two rollers or drums.

In FIG. 5, the suction devices 32 and 34 are arranged in the manner which has already been described in U.S. Pat. No. 4,130,983 and the German published application No. 2,656,787. According to these disclosures, it is required that the opening faces or suction mouths oppose each other only in a narrow overlapping area which is no larger than 10 times the thread diameter. Due to the inclination of the boundary lines or trailing edges 33 and 36, this narrow overlapping area or region is consequently inclined to the common normal plane 27 in such a way that the overlapping area itself is positioned at a gradually increasing distance from the normal plane.

In FIG. 6, the opening faces or suction mouths 31 and 35 of the suction devices 32 and 34, respectively, face each other completely but in this instance it is essential for the opposing suction mouths to be located not on the receiving side of the common normal plane 27 where the fibers are deposited and the thread is formed, but rather on the other side of this normal plane 27 below the line or plane of thread formation. In this case, the air suction is not directed into the nip being used for thread formation. Nevertheless, because the upper boundary lines or edges of the suction mouths are inclined together as indicated in FIG. 6, the line of thread formation and its corresponding plane of thread formation are again inclined at a slight angle to the common normal plane. Here again the nip gradually increases in width in the direction of thread draw-off as viewed in the plane of the thread formation line.

In a test of the apparatus according to FIG. 5, a polyester thread (polyethylene terephthalate, Nm=40) was first produced using the prior conventional arrangement of the opening faces or mouths 31, 35 parallel to the normal plane 27, and the resulting spun thread had a tensile strength of 15.5 Reiss-kilometer (Rkm). By comparison, with the inclined arrangement of the opening faces or suction mouths according to the invention, the resulting spun thread exhibited a tensile strength of 20.0 Rkm.

In another variation of the test apparatus of FIG. 5, the two opening faces or mouths 31, 35 were made parallel to the normal plane 27, but the narrowest gap of the normal plane was widened from 5/100 mm up to 17/100 mm over the length of the thread forming zone, i.e. from the open end to the draw-off end. In this case, the spun thread product with all other conditions being the same exhibited a tensile strength of 20.2 Rkm.

Using the apparatus of FIG. 6, a first test with the opening faces or mouths parallel to the common normal plane 27 resulted in a tensile strength of 13.4 Rkm, whereas under the same conditions but with an inclined arrangement of these opening faces according to the invention, the same polyester thread (Nm=40) gave a tensile strength of 18.6 Rkm.

The thread velocity was 300 m/min in all of the tests set forth above. For purposes of definition, it is well understood in this art that the tensile strength measurement of Reiss-kilometer may be equated with the force per unit of yarn size according to one of the formulae:

$$\text{Reiss-kilometer (Rkm)} = 9 \times \text{gm/denier; or}$$

$$1 \text{ Rkm} = 1 \text{ g/tex.}$$

Also, the abbreviation "Nm" is the metric number of the yarn size where $$1 \text{ Nm} = 1{,}000 \text{ tex.}$$

The present invention is based upon the surprising discovery that the formation of the twisted thread in the open-end or round-about spinning processes can be markedly improved in terms of both tensile strength and uniformity if the distance between the roller surfaces most strongly influencing the twisting of the fibers into the thread on the plane in which the thread is formed (thread formation plane) increases as the thread proceeds in the draw-off direction. The present invention offers two equally useful adjustments of the otherwise well known apparatus, either of which will result in a gradual increase in the width of the nip as it appears in the plane of the thread formation and in going from the initial or open end of this thread forming plane to its outlet or draw-off end. Thus, one adjustment is to widen the narrowest gap which is in the common normal plane of the two roller or drum surfaces. The thread formation plane then preferably coincides with this common normal plane, although it will be apparent that an additional widening effect can be achieved by combining the second useful adjustment with the widening of the narrowest gap. Thus, the second adjustment is achieved by increasing the distance of the thread forming line or plane from the plane of the narrowest gap, i.e. from the normal plane which is common to the two roller surfaces, in the direction of the thread draw-off. This second adjustment is best accomplished by a corresponding inclination of air suction mouths which tend to stabilize the position of the thread forming line and its plane at about the same inclination.

The invention in the adjustment of the effective nip width according to the present invention is quite effective when applied to each of the arrangements of suction devices with their open faces or suction mouths as shown in any of FIGS. 3, 5 and 6. Optimum results are obtained when adopting the present invention for use with the suction arrangement of FIG. 5.

The formation of the thread by open-end or round-about spinning is effected within the thread forming plane 38 in each of FIGS. 3, 5 and 6. The thread forming plane and the corresponding line of thread formation in FIG. 3 is essentially defined by the upper or leading edge 39 of the suction device 34 where the roller 1 acts in a conveying direction out of the wedge-shaped nip. It is necessary of course to adjust the speeds of the rollers and the forces of air suction in order to achieve a balanced system. In this respect, the thread formation line and the thread forming plane require a cooperation of rollers, feed supply of fibers, air suction and draw-off means to obtain a coherent spun thread. However, high strength threads of uniform quality require something more than balancing the known arrangements of these elements as is proven by the comparative tests above. Only by adopting the widening nip feature of the present invention has it been possible to obtain a remarkable improvement in results, especially with the apparatus of FIG. 3.

The other arrangements are also quite useful, however, and may be used where necessary to accommodate existing apparatus or equipment. Thus, in the arrangement of the suction devices in FIG. 5, the thread forming plane 38 and the line of thread formation is essentially defined by the two boundary lines or trailing edges 33 and 36.

In the arrangement of suction devices in FIG. 6, the thread forming plane 38 and the corresponding line of thread formation are defined by the boundary lines or upper edges 40 and 41 of the suction devices 34 and 32, respectively. A self-adjusting effect takes place here. In particular, the thread forms such that the forces of the air currents produced by the suction devices 32, 34 are in equilibrium with the mechanical conveying forces imparted by the rotating roller 1 which leads out of the wedge-shaped nip.

The specific improvement of this invention is therefore generally recommended in all such variations of open-end or round-about spinning.

The invention is hereby claimed as follows:

1. In an apparatus for the open-end or round-about spinning of a twisted thread from individual discrete fibers, said apparatus including two elongated drums, at least one of which is perforated, said drums being arranged to rotate in the same direction and to provide a wedge-shaped nip ending at the common normal plane of said drums to define the narrowest gap which is formed by the respective generatrix lines of the two drums, air suction means with an opening face located within each perforated drum to produce an air stream entering into each perforated drum and cooperating with said drums to produce a line of thread formation extending longitudinally within said wedge-shaped nip, a feed channel to supply the individual fibers by means of an air stream directed into said wedge-shaped nip along said line of thread formation, and means to take off the twisted thread emerging from said thread formation line at one end of said nip, the improvement which comprises:

an arrangement of said two drums and said air suction means with respect to said thread take off means such that the width of the wedge-shaped nip increases on the plane of said thread formation line in the thread take-off direction.

2. Apparatus as claimed in claim 1 wherein the line of thread formation is inclined to the common normal plane of said drums such that the distance between said thread formation line and said common normal plane increases in the thread take-off direction.

3. Apparatus as claimed in claim 2 wherein both drums are perforated, said line of thread formation is defined by the boundary lines of the opening faces of air suction means located within each drum, and said opening faces with regard to their boundary lines are inclined to said narrowest gap such that the distance between said boundary lines and said narrowest gap increases in the thread take-off direction.

4. Apparatus as claimed in claim 1 wherein the drums are arranged such that the width of said narrowest gap increases on the common normal plane of said drums in the thread take-off direction.

5. Apparatus as claimed in claim 4 wherein the plane of said thread formation line coincides with said common normal plane of the drums.

6. Apparatus as claimed in claim 4 wherein the plane of said thread formation line lies outside of the common normal plane of the drums, but intersects said common normal plane on a line substantially perpendicular to the thread formation line.

7. Apparatus as claimed in claim 1 wherein the drums are arranged such that in the plane of said thread formation line in the region of the open end of the thread being formed, the width of the wedge-shaped nip amounts to less than 50% of the diameter of the spun thread and increases over the length of said thread formation line by at least about two times this width.

8. Apparatus as claimed in claim 7 wherein said width of the wedge-shaped nip in the region of said open end of the thread amounts to less than about 30% of the diameter of the spun thread and increases over the length of said thread formation line by at least about three times this width.

9. Apparatus as claimed in claim 7 wherein said width of the wedge-shaped nip in the region of said open end of the thread amounts to about 10 to 30% of the diameter of the spun thread.

10. Apparatus as claimed in claim 9 wherein the width of the wedge-shaped nip increases over the length of said thread formation line by about three to ten times the initial width in the region of said open end of the thread.

11. Apparatus as claimed in claim 1 wherein said feed channel supplying the individual fibers is mounted with its feed opening substantially parallel to the narrowest gap and is associated with means to feed the individual fibers into the narrowest gap at a high rate of flow.

12. Apparatus as claimed in claim 11 wherein the feed channel and its opening form an angle of less than 30° with each other.

13. Apparatus as claimed in claim 12 wherein said feed channel is inclined such that the individual fibers are directed by said air stream with a component of movement directed against the take-off direction of the thread.

14. Apparatus as claimed in claim 1 wherein the perforated drums are constructed as hyperboloids.

15. Apparatus as claimed in claim 14 wherein the perforated drums are constructed and arranged as asymmetrical hyperboloids such that the thread passes through said narrowest gap from the inlet side where the thread formation begins and where the cross-sectional diameter of the drums is the largest up to the outlet side where the formed thread is taken off and where the cross-sectional diameter of the drums is substantially smaller than at the inlet side.

16. Apparatus as claimed in claim 1 wherein the opening faces of the air suction means within the drums are arranged on both sides of the thread formation line, said opening faces respectively having a trailing longitudinal edge portion which extends longitudinally adjacent said line of thread formation, and said longitudinal edge portions having relative positions overlapping each other in the zone of said thread formation line by an overlap with of not more than 10 times the thread diameter.

17. Apparatus as claimed in claim 1 wherein the air suction means within a first perforated drum conveying fibers into the wedge-shaped nip has a wider opening face than the air suction means in a second perforated drum conveying fibers out of the wedge-shaped nip, and wherein the wider opening face of said suction means in said first perforated drum, as viewed in the direction of rotation of said first drum, extends from a region upstream of the plane of the thread formation line into the region of the narrowest gap between the two drums, while the narrower opening face of said suction means in said second perforated drum, as viewed in the direction of rotation of said second drum, extends from the region of the narrowest gap between the two drums into the region of the plane of the thread formation line.

18. Apparatus as claimed in claim 1 wherein each of the air suction means is arranged within its respective drum such that its opening face, as viewed in the direction of rotation of the drum conveying fibers into the wedge-shaped nip, extend from the region of the plane of the thread formation line to a region beyond the narrowest gap between the two drums.

* * * * *

UNITED STATES PATENT AND TRADEMARK OFFICE

CERTIFICATE OF CORRECTION

PATENT NO. : 4,241,571

DATED : December 30, 1980

INVENTOR(S) : Turk et al

It is certified that error appears in the above-identified patent and that said Letters Patent are hereby corrected as shown below:

In column 12, at line 41, change "overlap with" to --overlap width--.

Signed and Sealed this

*Seventh* Day of *April 1981*

[SEAL]

*Attest:*

RENE D. TEGTMEYER

*Attesting Officer* *Acting Commissioner of Patents and Trademarks*